United States Patent [19]

Hackmann et al.

[11] Patent Number: 4,767,023

[45] Date of Patent: Aug. 30, 1988

[54] DISPENSER FOR TABLETS

[75] Inventors: Ludger Hackmann; Josef Wilken, both of Lohne/Oldbg., Fed. Rep. of Germany

[73] Assignee: Bramlage Gesellschaft mit beschrankter Haftung, Fed. Rep. of Germany

[21] Appl. No.: 853,741

[22] Filed: Apr. 18, 1986

[30] Foreign Application Priority Data

Apr. 27, 1985 [DE] Fed. Rep. of Germany ..... 3515302

[51] Int. Cl.[4] ..... B65D 83/04

[52] U.S. Cl. ..... 221/152; 221/154; 221/190; 221/248

[58] Field of Search ..... 221/151, 152, 154, 186, 221/190, 248, 269; 215/220

[56] References Cited

U.S. PATENT DOCUMENTS

| | | | |
|---|---|---|---|
| 1,889,232 | 11/1932 | Ware | 221/269 X |
| 2,559,287 | 7/1951 | Duell et al. | 221/246 |
| 3,102,662 | 9/1963 | Crabtree | 221/151 |
| 3,159,308 | 12/1964 | Passavanti | 221/190 X |
| 3,471,056 | 10/1969 | Kovac | 221/151 |
| 3,866,796 | 2/1975 | Bozek | 221/152 |
| 3,921,851 | 11/1975 | Nilson | 221/151 |
| 4,124,143 | 11/1978 | Thomas | 221/154 X |
| 4,230,236 | 10/1980 | Boulter | 221/190 |
| 4,418,838 | 12/1983 | Gallina | 221/269 X |
| 4,428,502 | 1/1984 | Veltri | 221/152 |

FOREIGN PATENT DOCUMENTS

| | | | |
|---|---|---|---|
| 3410005 | 9/1985 | Fed. Rep. of Germany . | |
| 1328990 | 4/1963 | France | 221/263 |

*Primary Examiner*—Robert J. Spar
*Assistant Examiner*—P. McCoy Smith
*Attorney, Agent, or Firm*—Wood, Herron & Evans

[57] ABSTRACT

A dispenser for tablets is disclosed which protects against inadvertent dispensing, e.g., by children. The dispenser includes a housing forming a tablet storage compartment, a movable slide and an operating key for the slide mounted adjacent a wall of the housing. A detent blocks movement of the slide toward a discharge position. The detent is mounted on the housing remote from the operating key. The slide is moved by simultaneous movement of the detent and operating key.

17 Claims, 9 Drawing Sheets

FIG. 1
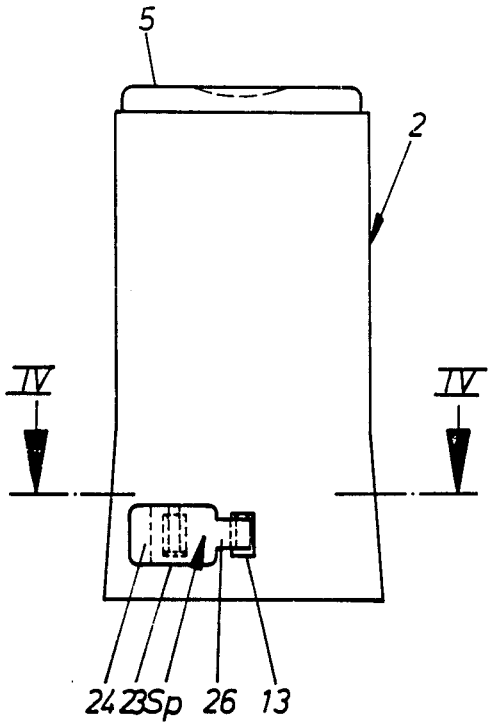
FIG. 2
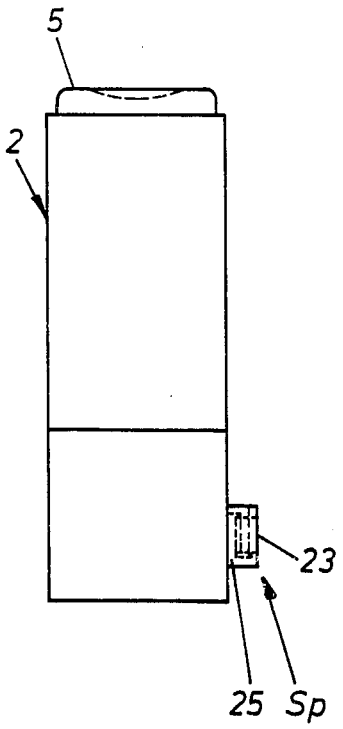
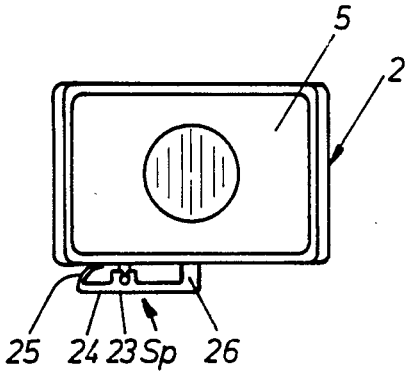
FIG. 3

FIG. 7
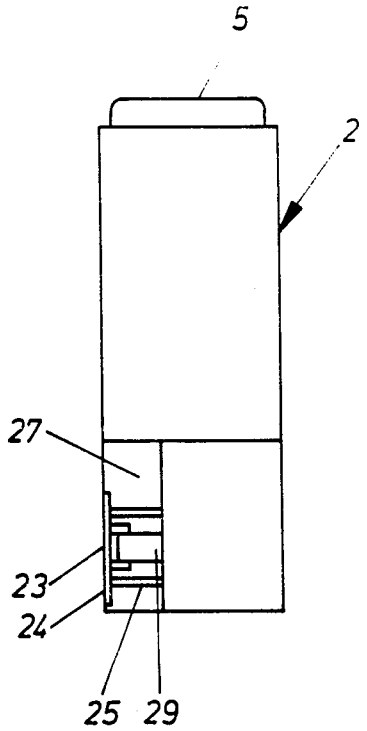
FIG. 6
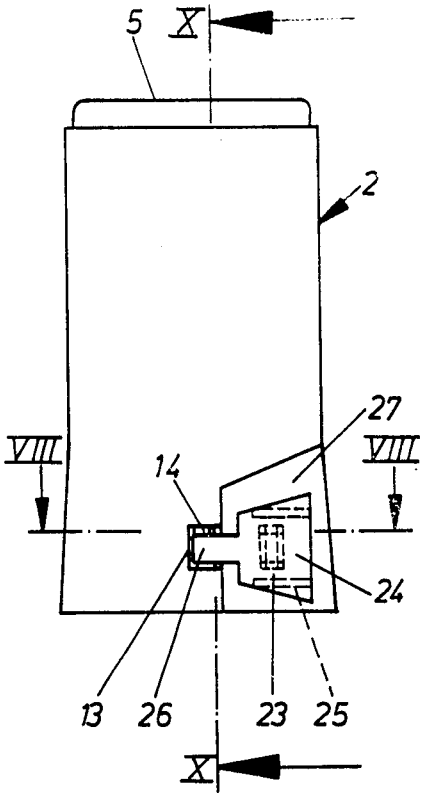
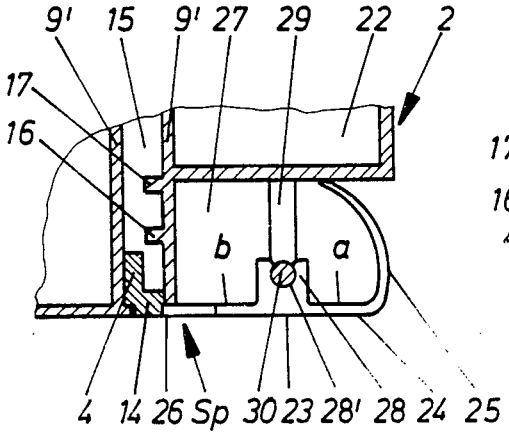
FIG. 8
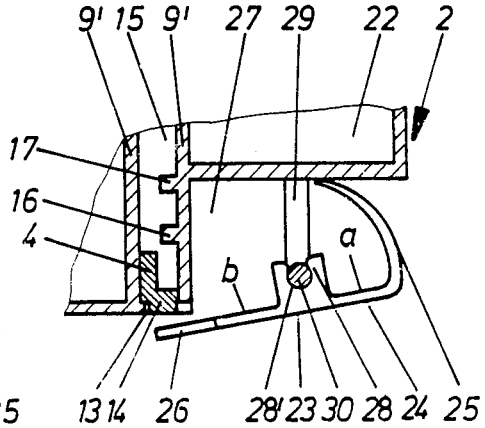
FIG. 9

DISPENSER FOR TABLETS

BACKGROUND OF THE INVENTION

The invention relates to a tablet dispenser of the type including a slide arranged in a housing forming a tablet storage space and an operating button located adjacent a wall of the housing, the button being shiftable, against spring force, toward the inside of the housing, in which inward position it moves a tablet dispensing section into registry with a tablet drop opening.

It has previously been suggested in a German patent application assigned to applicants' assignee to provide a tablet dispenser including a slide, which is not spring-loaded in the closing direction, and means securing the slide against movement to provide protection against operation by children. The design is such that the end of the slide includes longitudinal slits divided by it into two strips which can be forced against each other elastically. One strip has on its outside a catch which engages a latch opening at a depth which is smaller than the travel of the strip when the strips are forced against each other elastically. With such design, the manipulation for opening occurs at one spot of the dispenser.

On such a dispenser where a housing wall forms the operating key of a slide which can be moved against spring force toward the inside of the housing, a tablet can be released practically unnoticed merely by touching the dispenser. This is disadvantageous since it can lead to an uncontrolled dosing and to an unnecessary loss of tablets.

SUMMARY OF THE INVENTION

The problem underlying the present invention is to improve dispensers of the type described by providing effective child protection so that dispensing is possible only through a deliberate additional operation, and coincidental touching of the operating surface will no longer lead to an unintended dispensation.

This problem is solved by providing a dispenser including in combination a housing defining a tablet storage compartment, a slide movably mounted within the housing, and an operating key for the slide disposed adjacent to one wall of the housing, a spring resisting movement of the operating key in one direction and detent means for blocking movement of the slide between a tablet discharge position and a position blocking tablet discharge. The detent is spring urged into the position in which it blocks the slide and is mounted on the housing in a location spaced from the slide operating key.

In the present application, several embodiments are disclosed which utilize the principles of the present invention and provide additional advantages.

The present invention is predicated in part upon the concept of providing a safer dispenser which requires actuation of two members at two different locations spaced from each other. In order to provide optimum child protection, this spacing should exceed the span of a child's hand. This reduces the risk especially with regard to toddlers. The child can operate only one of the two members, i.e. the operating key or the latch. A handling of both areas in proper sequence, for instance, with the use of both hands, would accidently occur extremely seldom. Additionally, the movement of a member is against spring force.

The present dispenser actuating mechanism is, however, simple to operate in the intended fashion. In one embodiment, the operating key is located on the top wall while the latch is disposed near the bottom end of the housing side wall and is operable in a plane transverse to the slide movement. The latch is preferably of a rocker-type design and includes one rocker arm that forms the operating surface. This rocker arm extends into an elastic section. A second rocker arm forms a blocking finger which in latched position is located behind a shoulder of the slide. The elastic section may be molded to the rocker type latch. The slide shoulder is suitably formed by a lug which is movable in a slot in the housing wall. The latter may additionally be utilized as a slide stop. Preferably the slot forms the tablet discharge opening and the blocking finger is movable out of the slot area to a position spaced from the opening by more than one tablet diameter. Thus, it is not sufficient to move the locking finger only far enough for the catch to release the slide. Instead the tablet is dispensed only when the finger has been shifted though its entire throw suitably limited by a stop.

In a preferred embodiment of the latch, the lock is recessed in a sideways depression in the housing wall. This helps to avoid accidental touch or catching on clothes, for instance, on the sleeve. It is also preferable that the latch extend practically as a complement to the housing wall. In such a construction the presence of the latch is not readily recognizable. The device, therefore, is much more readily operated by a person familiar with it. This greatly increases the child protection which is sought. Preferably, the rocker arm is mounted by way of a snap-in connection. In a preferred embodiment, the two rocker arms are of different lengths so that the arm forming the blocking finger is longer than the other rocker arm which carries the operating surface. It has been found advantageous to provide a latch which includes a restoring catch which intersects the path of the slide while its scanning recess interacts with a lug on the slide. As soon as the lug and scanning recess coincide, the slide can be moved while releasing a tablet.

An embodiment for optimizing child protection includes a paired restoring catch arrangement in which two oppositely movable restoring catches share in forming the scanning recess. The opposite movement of these catches requires also two appropriately located operating surfaces. Consequently, including the operating key of the slide, a total of three areas must be operated to bring about the release of a tablet.

In another preferred embodiment, each of the restoring catches is connected by way of a foil hinge with the rocker lever. Due to the reset force effective here, the foil hinge additionally supports the spring effect of the rocker lever. In one preferred embodiment, the latch is formed by a rocker arm which interacts with the lower shoulder of a guide lug of the slide with the arm overlapping a corner and engaging in the locked position, in form-fitting manner, a window-type niche in the housing side wall. The latter measure keeps the rocker lever itself practically free of load, for instance, in the case of an isolated operation of the operating key, the pressure load is absorbed by the more stable housing of the dispenser. In another modification the latch is constituted by a slide key projection which points against the direction of slide movement and forms a dividing finger. In the spring-loaded home position, the slide key lies adjacent to the front wall of the slide, locking it. In the release position, the finger can be moved to a position extending through an opening in the front wall where the tablet ready for dispensation is separated from the rest of the supply. An embodiment of the latter type, in terms of design, proves to be extremely simple insofar as the latch, more accurately, the slide key, assumes a double function (blocking element and divider finger). Additionally, according to another embodiment, the rocker lever protrudes with its arm in the path of a slide projection. This rocking movement of the rocker arm releases the projection so that subsequently the operating key can be moved. Lastly, in another embodiment, the latch is formed by an arm of an angular rocker lever mounted in the fulcrum. The arm points in a direction opposite to the direction of slide movement. The arm lies in the spring-loaded home position with its free end before the front wall of the slide so as to lock it and, in the release position, enters the space between the slide and the arm forming the operating surface. This results in an easy to operate and, with regard to the operating mechanism compact design, all the more so as the arm lies in the spring-loaded home position in the plane of the housing wall and diametrically opposite from the operating key located on the other side. The recessed snap-on arrangement of the rocker lever is preferably accomplished through diagonal cuts in the stump end faces which form a run-on bevel for the axial snap-on pin arrangement.

The present invention will be more fully explained hereafter with the aid of several illustrated embodiments.

BRIEF DESCRIPTION OF THE DRAWINGS

FIG. 1 shows a front elevation of the inventional dispenser, and at that, according to the first embodiment.

FIG. 2 is a side elevational view of the dispenser.

FIG. 3 is a plan view of FIG. 1.

FIG. 6 is a front elevational view of a second embodiment of the dispenser.

FIG. 7 is a side elevation, from the left.

FIG. 8 is a section along line VIII—VIII in FIG. 6 showing the latch scaled-up and in locked position.

FIG. 9 is a section corresponding to FIG. 8 with the latch in release position.

FIG. 18 is an enlarged sectional view of the area of the pin attachment point of the rocker arm.

DESCRIPTION OF PREFERRED EMBODIMENTS

Figure 4:
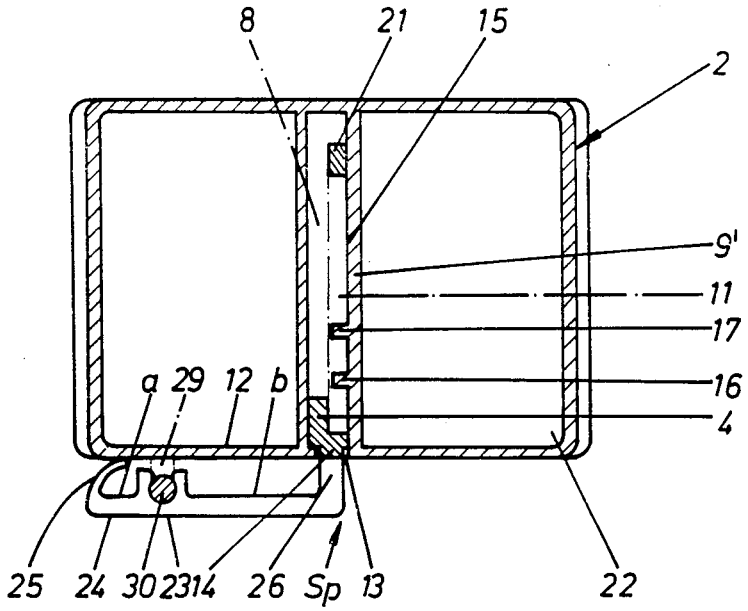
FIG. 4 is a section along line IV—IV in FIG. 1, scaled-up, and with the latch in locked position.
Figure 5:
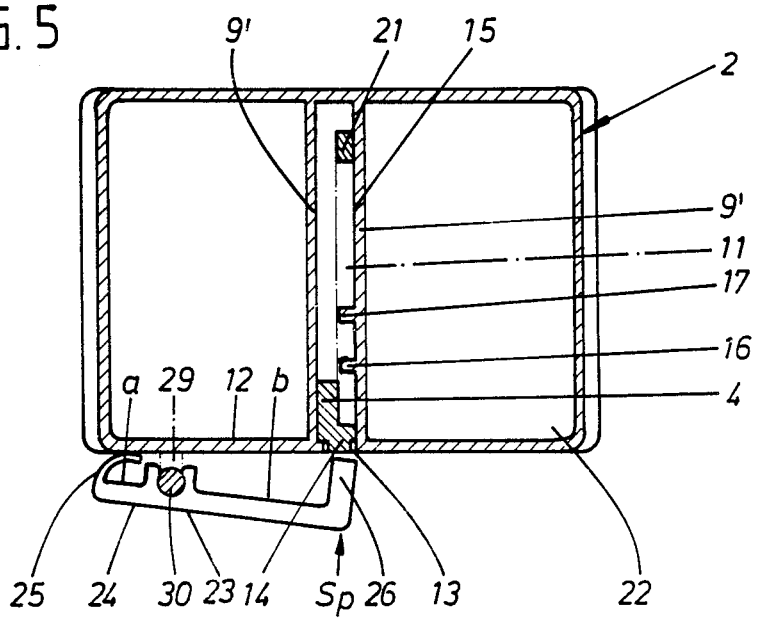
FIG. 5 is a section as in FIG. 4, but with the latch opened.

As shown in FIGS. 1–3, one preferred form of tablet dispenser includes a housing 2. This housing forms a tablet holding space 1. Housing 2 has a boxed design, except for the seventh embodiment. The contents consist of disk-type goods, for instance, tablets 3.

The tablets 3 are separated by a linearly, for instance, vertically or horizontally, movable slide 4. The latter has a frame type design and extends upwardly into exposed operating key 5. Slide 4 is a component which occupies the entire internal clearance of the holding space 1 as a cap-shaped closure which, acting practically as a housing wall, nests over the contents while providing an upper closure. The operating key 5 may be molded directly to the slide 4.

Figure 10:
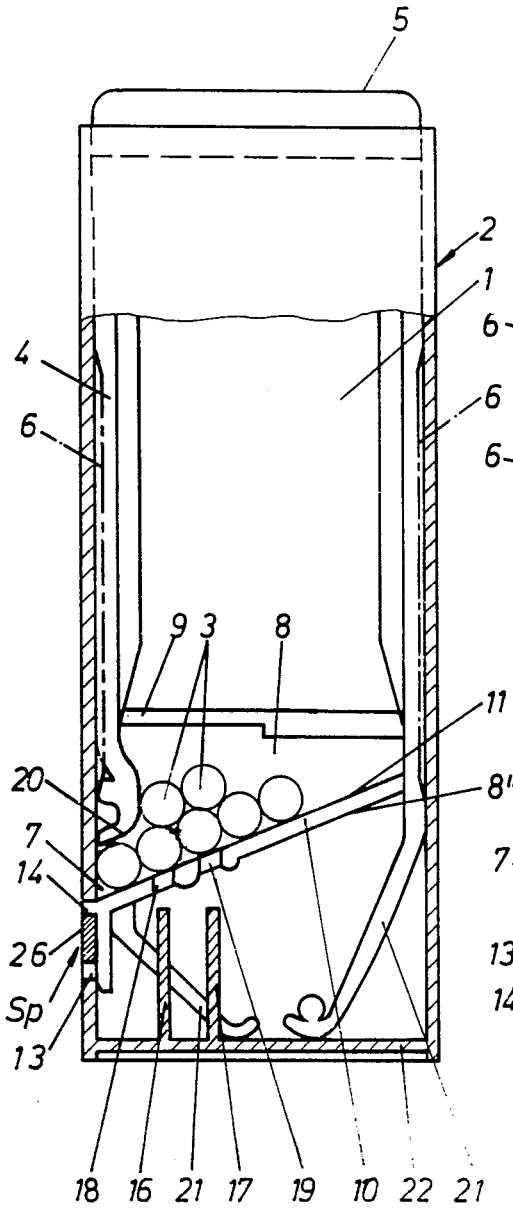
FIG. 10 is a section along line X—X in FIG. 6 in locked position.
Figure 11:
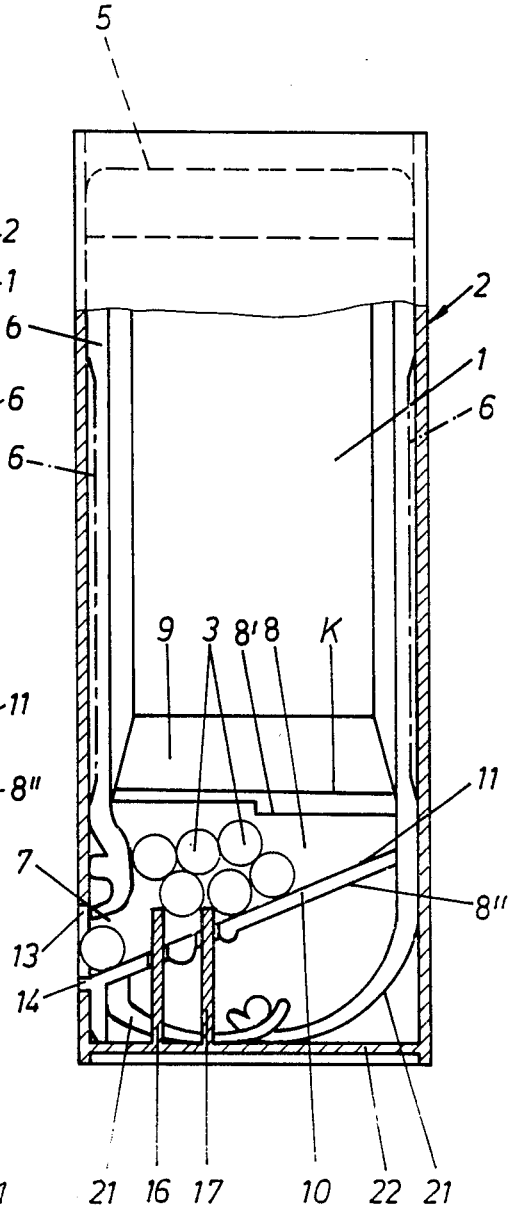
FIG. 11 is the same section as in FIG. 10 in released position with the dispenser ready for dispensation.

Two vertical shanks of the frame-shaped slide 4 run in guides which are formed by strips 6 (refer to FIG. 10).

The slide 4 forms a tablet lock and/or a cross-section 7 adapted to the tablet size. More particularly, the lower section of the slide 4 forms a side wall 8 extending from vertical shank to vertical shank. In its home position (FIG. 10), the slide 4 assumes a position where its side wall 8 protrudes beyond a fillet K of two housing bottom walls 9 which extend at a roof-shaped inclination to each other. This protrusion may correspond to the tablet diameter. The top edge 8' of the side wall 8 extends horizontally and includes in its center area a slight stepped offset.

The side wall 8 includes a side rib 10 disposed in the area of its lower edge 8''. The top side of the rib forms a chute, or rolling ramp, 11 for the tablets 3 which collect on its standing upright. The rolling ramp 11 has a relatively steep slope (about 30° ) toward the dispensing cross-section 7. In the closed position (FIG. 10), this dispensing cross-section 7 is outwardly closed by the housing wall 12 extending in front of it. Only as the slide 4 moves downward will the dispensing cross-section 7 assume a position coinciding with a tablet drop opening 13 in said housing wall 12. The drop opening 13 is formed by a slot extending in the direction of movement. Limiting the stroke and serving as a catch between the slide and the housing, a lug 14 protrudes into the slot. The play between the slide 4 and the inside wall of the housing allows the respective blocking movement. The outside of the lug is coplanar with the outside wall of the housing.

In addition to the lug 14, a narrow recess 15, provided just above the bottom surface of the housing, provides additional guidance to the slide in its bottom area. This recess is essentially in alignment with the guides formed by the strips 6. The recess 15 is formed by immediately adjoining vertical sections 9' of the bottom walls 9. The recess 15 is half-filled, essentially by the side wall 8, whereas the other half forms an ordering collecting shaft for the tablets.

Originating from the shaft-defining section 9', on the right side in FIG. 4, are two divider fingers 16, 17. These extend in the direction of slide movement and intersect the side rib 10 which includes passage openings 18, 19 corresponding to the rib cross-section. The parallel spacing of the two divider fingers 16, 17 relative to each other is chosen smaller than the diameter of a tablet 3.

The divider fingers 16 and 17 pass through the openings 18, 19 only as the slide 4 is lowered. They have a loosening effect on the tablets and, in addition, hold the next to the last tablet back. As the rolling ramp 11 is lowered, the tablets lined up in dispensing direction will move slightly and loosen up in such a way, due to the relative movement between the side wall 8 and the section 9' forming the shaft on the right-hand side, that no binding position of the tablets is possible which otherwise may occur with tablets having lenticular shape. Above the stationary divider finger 16, the slide forms a reversing shoulder 20 which extends parallel to the rolling ramp 11. The reversing shoulder 20, together with the side rib section located on the right of the passage opening 18, forms sort of a directional funnel.

Springs 21 are directly molded to the slide 4 and urge the slide 4 toward its home position (FIG. 10). These springs are two tabs which bear on the bottom surface 22 which is carved out in the transverse center area of the housing 2. The springs are offset sideways, allowing them to pass by one another as the operating key is pushed.

In the home position (FIG. 10), the slide 4 is blocked by means of a detent Sp which is located a distance from the operating key 5. The latch can be moved only deliberately against spring force to its release position. It engages with its blocking end the drop opening 13 of the housing 2 formed by the slot. It also engages the underside of lug 14 which is located in the opening direction of the slide.

On nearly all embodiments, the space between the operating key 5 and the detent Sp, arranged in the area of the bottom end of the housing side wall 12, is a measure exceeding the span of a child's hand. Additionally, its operation requires a sequentially correct operation of the key T and the latch Sp. Accidently touching the somewhat protruding operating key 5, for instance, when reaching for the dispenser, does not lead to a tablet dispensation. Operation of the dispenser requires that handling must be deliberate and, to a certain extent, with concentration.

In some of the embodiments, the detent Sp is fashioned as a dual-arm rocker lever 23 which can be operated transverse to the slide movement. Its one rocker arm a forms the operating surface 24. This arm carries a fold-under spring section 25 bearing on the housing. This section may be a relatively narrow, bent strip of material which is molded on.

The other rocker arm b carries on its end a blocking finger 26 which, in blocking direction, engages the slide shoulder formed by the lug 14.

On the dispenser according to the first embodiment, installation of rocker lever 23 requires angling the blocking finger 26 in the direction of the tablet drop opening 13, with the forked spring section 25 bearing on the wall 12 of the dispenser housing 2. According to the second embodiment (FIGS. 6–11), the detent Sp is located in a sideways recess 27 located in a corner area of the housing wall 12. It is so recessed that the outside surface of the rocker lever 23 is flush with the outside of the housing wall 12. The blocking finger 26 engages the drop opening 13 sideways, for which reason the slot forming this drop opening is opened toward the recess 27 by partial undercutting of the section 9' of the shaft 15.

In all corresponding embodiments, the swing area of the rocker lever 23 has an angular dimension such that the blocking finger 26 assumes a position relative to the tablet drop opening 13 spaced by a distance which exceeds the diameter of a tablet 3 so that the slot area is completely unobstructed.

The rocker lever is on all embodiments, except for the fifth embodiment (FIGS. 18–21), attached in snap-on fashion. In the first two embodiments, two snap-on tabs 28 extend from the inside of the rocker lever 23 and engage pins of an axle 30 of a support arm 29 on the housing. These pins are directed upward and downward and extend coaxially. The bearing recess 28' of the snap-on tabs 28 extends somewhat behind the diameter of the pins. On the housing side, it extends in sort of a catch funnel which facilitates the snap-on process. The snap-on tabs 28 extend partly over the top and bottom sides of the bearing arm 29 producing an axle retention. In the case of the first embodiment (FIG. 4), the bearing tabs 28 are continuous. They engage a continuous pin of the axle 30. The latter originates from the housing wall 12 as a hook molded to it. For axial retention, the free end of the pin pointing outward is widened. The upper axial limiting stop is provided by the arm 29 which is directed at the housing wall 12 and anchored to it.

The rocker arms a, b are unevenly long with the rocker arm b, forming the blocking finger 26, being longer than the other rocker arm a which forms the operating face 24. The ratio is 2:1, requiring elevated operating forces.

Instead of leaving a slight space between the bottom edge of the blocking finger 26 and the corresponding drop opening edge, finger 26 can bear directly on it, thereby providing relief for the bearing points of the rocker arm.

For the embodiments 3–7 described hereafter, the reference figures are being used analogously, partly without repetition of text.

Figure 12:
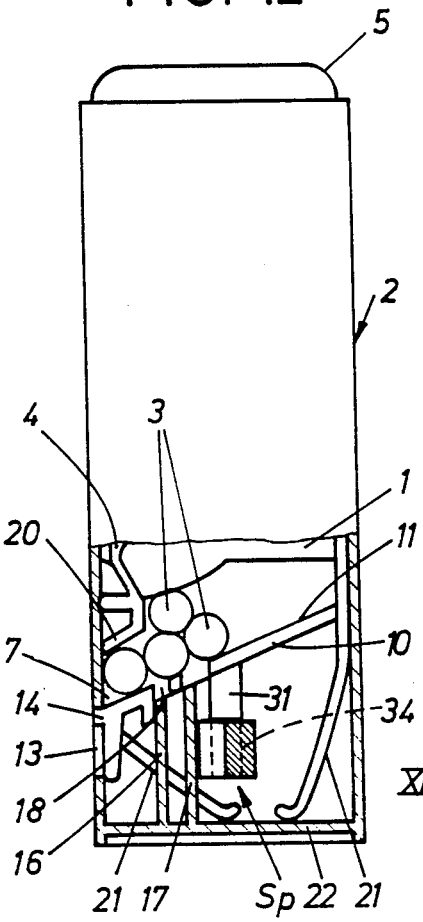
FIG. 12 is the dispenser according to the third embodiment (partially cut away in the lower area).
Figure 13:
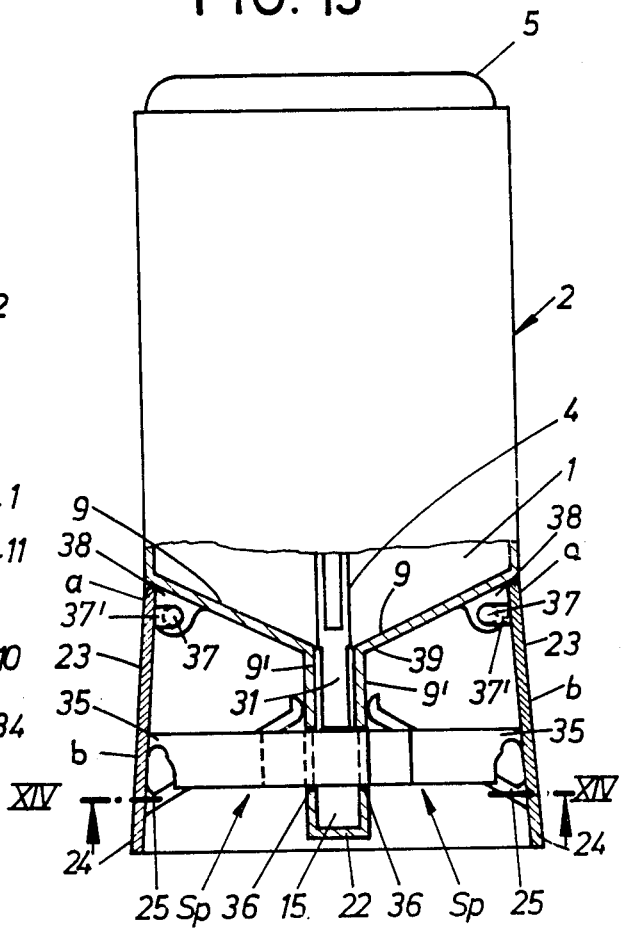
FIG. 13 is a side elevation, from the left, cut away at the bottom.

The third embodiment (FIGS. 12–14) corresponds in its basic concept greatly to the two embodiments described before. For instance, the slide 4 also forms a lowerable rolling ramp 11 for the tablets 3 accumulating on it while standing on edge. But additionally, a nose 31, pointing in the direction of movement, originates from the underside of the side rib 10 of the slide 4 which forms the rolling clamp 11. In the spring-loaded home position of the detent Sp, nose 31 is located adjacent to the top side of two restoring latches. These latches have a paired and opposite arrangement forming, by means of grooves 33, a joint recess 34 (see FIG. 12). The grooves 33 form a recess cross-section corresponding to that of the nose 31 which then can enter as the slide 4 is moved downward by means of the key 5. This results in releasing the tablet on the drop side and retaining the remaining supply as explained above.

Each of the latches 32 is connected through a foil hinge 35 to the rocker lever 23. The arm b forming the detent Sp, by way of the latches 32, provides on its back the operating face 24. The rocker arm a is considerably shorter. This arm defines the home position of the rocker arm by bearing with its narrow side facing toward the tablet holding space 1 on the underside of the respective bottom wall 9 in the area in which the rocker lever 23 is hinged.

A spring section 25 originates from the free end of the rocker arm b on the inside thereof. Spring section 25 bears on the shaft-forming section 9' of the shaft 15. The latter shaft includes coinciding guide openings 36 for the latches 32 intersecting the slide 4.

Figure 14:
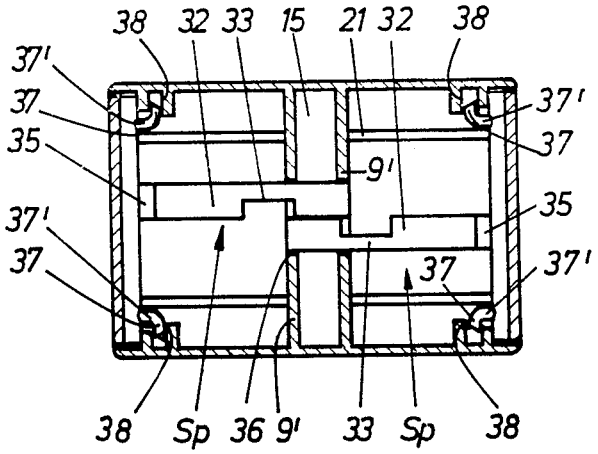
FIG. 14 is a section along line XIV—XIV in FIG. 13.

As shown in FIG. 14, the spring sections 25 are molded, in pairs, to each rocker lever 23. Also molded to the rocker lever are pins 37. Their end faces feature a diagonal cut providing run-on bevels for cooperation with the bushings 38 on the housing. The pin 37 is positioned next to the front edge of the bushings and is pressed until these bevels, due to the resistance of the material, snap into the bushings 38. The connection is irreversible. The axial sections of the pins 37 extend into rectangular holding arms 37' attached to the inside of the rocker lever 23.

The release position of the detents Sp is as well defined by a stop construction, i.e., their movement is limited when they bear with their free ends on the inside of the rocker lever 23 or the spring section 25 enters the inside corner 39 between the shaft-forming section 9' and the inclined bottom wall 9.

Figure 15:
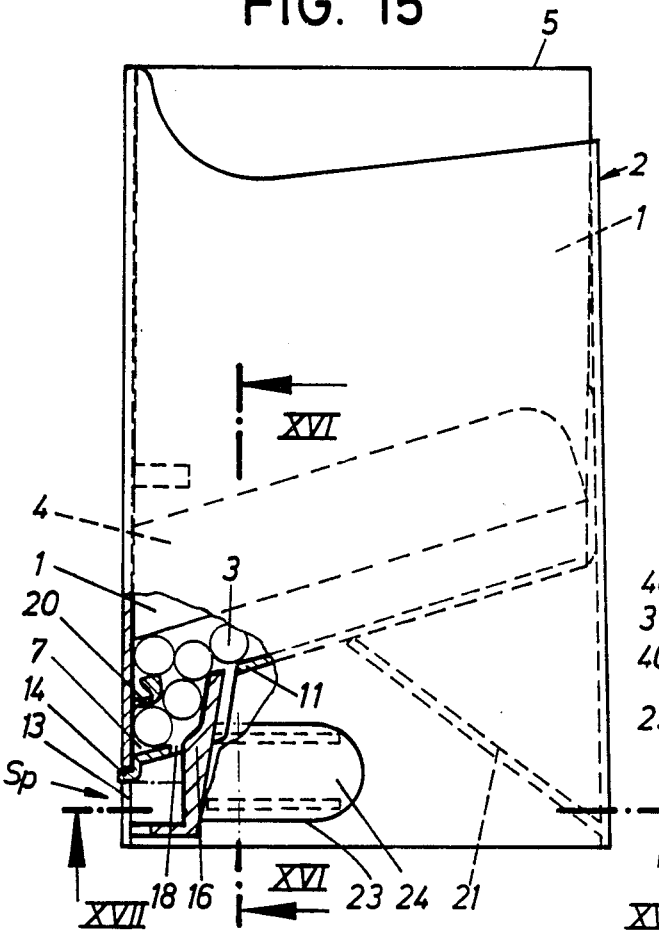
FIG. 15 is a side elevational view, partly cut away, of the dispenser according to the fourth embodiment.
Figure 16:
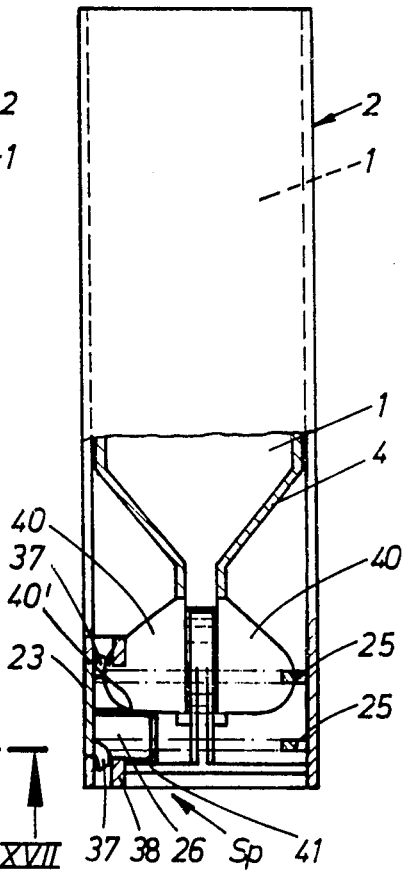
FIG. 16 is a section along line XVI—XVI.
Figure 21:
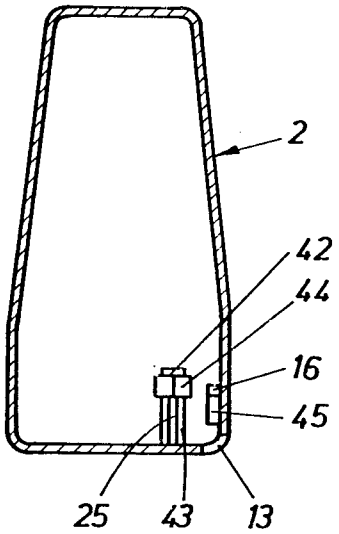
FIG. 21 is a section along line XXI—XXI in FIG. 20.

The vertical lowering principle of the slide 4 including the chute, or rolling ramp, 11 was retained also in the fourth embodiment (FIGS. 15–17), except that the only one divider finger 16 formed by the housing 2 separates the tablet ready for dispensation from the remaining supply. In this version, the slide 4 includes a pair of guide tabs 40 extending at the lever of the reversing shoulder 20 of the slide. Such guide tabs extend on the inside of the narrower wall of the housing, sideways of the tablet drop cross-section 7 which they function to stabilize.

Figure 17:
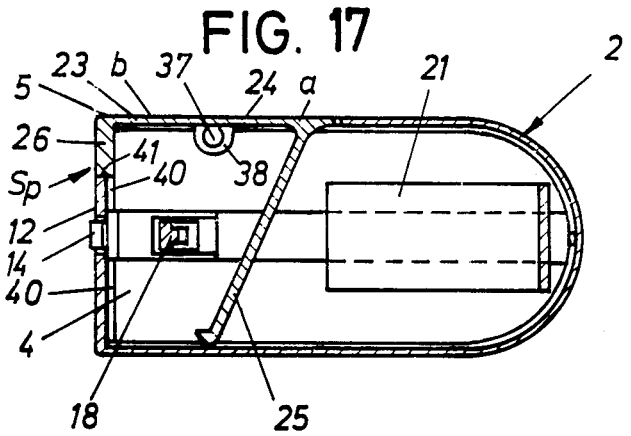
FIG. 17 is a section along line XVII—XVII in FIG. 15.

The detent Sp interacts with the lower shoulder 40' of one of the guide tabs 40. The detent is formed by a rocker lever 23 whose arm b, forming the blocking finger 26, engages, in blocking position, a window-type niche 41 in the housing side wall 12. Wall 12 is a narrow wall. Contrarily, the broadside wall accommodates in a correspondingly contoured recess the rocker lever 23 so that only a section of the rocker arm b, overlapping the corner, engages niche 41 which is located perpendicular to the broadside wall of the housing. The corresponding form-fitting engagement applies the operating force of the operating key 5, when not released, to the housing 2. Thus, the pivotal bearings of the rocker lever are extensively relieved. As shown in FIG. 17, the blocking finger has a width corresponding to the thickness of the housing wall 12 and of the guide tab 40.

The other rocker arm a, in turn, forms with its outside the operating face 24. Spring sections 25 extend from the inside of this arm a. Spring sections 25 are molded and bear on the opposite inside wall of the housing 2. In a variation of the basic concept of the first embodiment, the spring 21 stressing the slide 4 toward its home position attaches to the housing, near its bottom, while bearing with its free end on the underside of the chute and/or rolling ramp 11 of the slide. To release a tablet, the detent Sp must first be released; this opens the way for the vertical movement of the slide 4 with the aid of the key 5.

Figure 20:
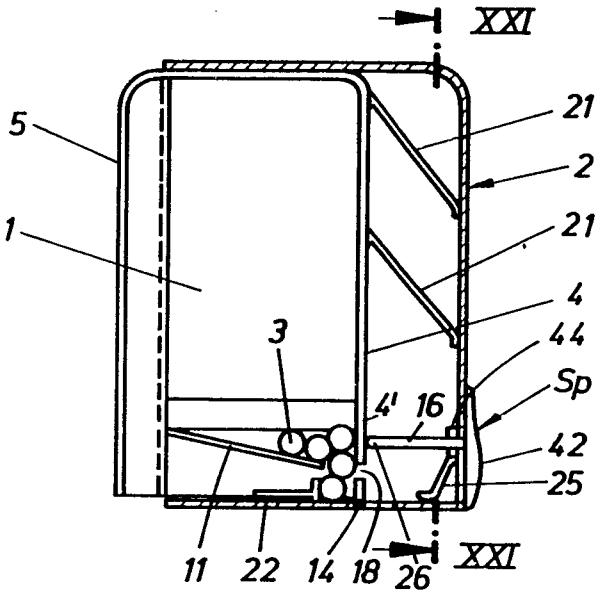
FIG. 20 is a section along line XX—XX in FIG. 19.
Figure 19:
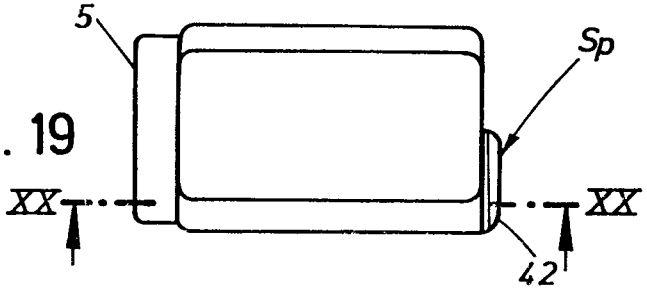
FIG. 19 is a plan view of the dispenser of FIG. 18.
Figure 18:
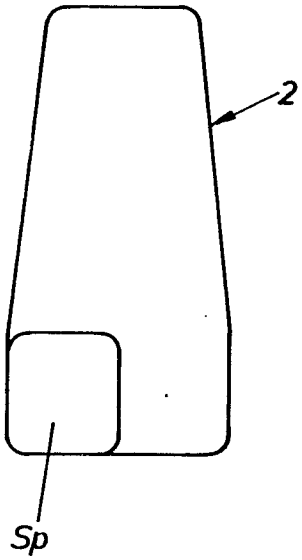
FIG. 18 is the dispenser according to to the fifth embodiment in front elevation.
Figure 22:
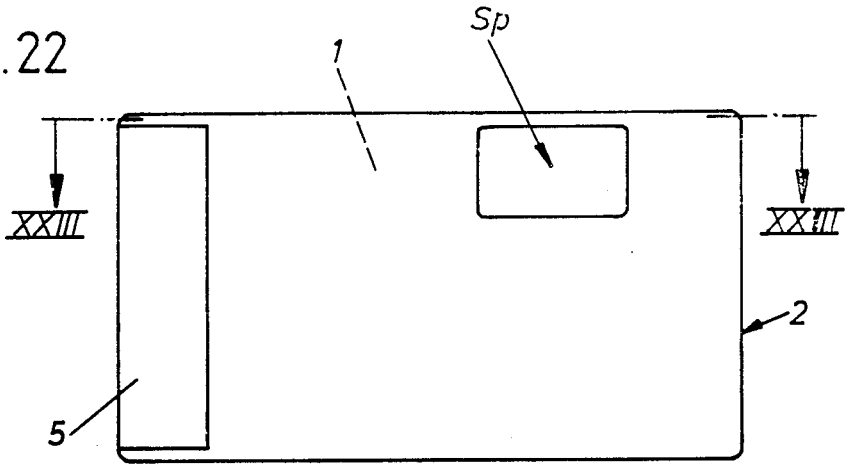
FIG. 22 is the dispenser according to the sixth embodiment in side elevation.

The fifth embodiment (FIGS. 18–22) provides for a horizontal movement of the slide 4 which is urged by directly molded-on springs 21 in the direction of the home position shown in FIG. 20. The reference figures have been used analogously. Thus, the function of the rolling ramp 11, and offset relative to the tablet dispensing cross-section 7, the tablet drop opening 13, which here, however, is not located in the side wall of the housing but in its bottom 22, can also be seen from FIG. 20. Varying from all of the preceding embodiments, a movable divider finger 16 is employed whose free end forms the blocking finger 26 of the detent Sp.

In this embodiment, the detent Sp is formed by a projection opposite to the horizontal opening direction of the slide 4. This projection also forms the divider finger 16. The projection is carried by a slide key 42 which moves vertically.

The divider finger 16 extends in its spring-loaded home or blocking position (FIG. 20) adjacent to the front wall 4' of the slide 4. Slide 4 can be shifted when released to a position separating the tablet ready for dispensing from the remaining supply. The slide is released when finger 16 is positioned in alignment with passage opening 18 in end wall 4'.

The slide key 42 runs in a vertical slot 43 of the housing 2. It is retained and guided by a locking projection 44 which extends through the vertical slot 43. The locking projection 44 is tapered, roof-shaped, in the direction of insertion and includes, on its bottom side, a molded-on spring section 25 which bears on the bottom 22 of the housing. The horizontally aligned dividing finger 16 runs in a separate vertical slot 45 (see FIG. 21).

Figure 23:
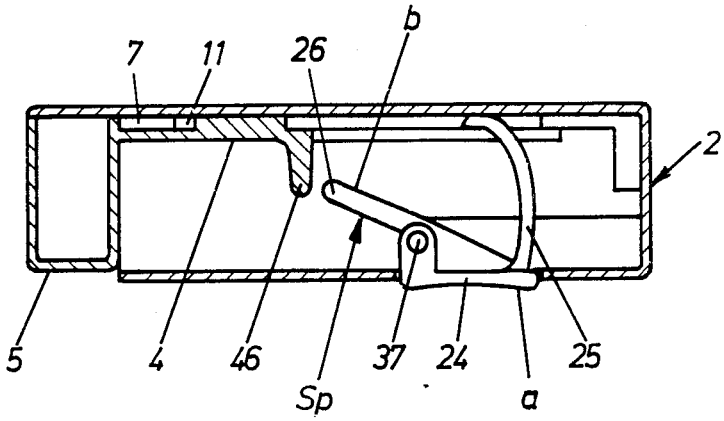
FIG. 23 is a section along line XXIII—XXIII in FIG. 22.
Figure 24:
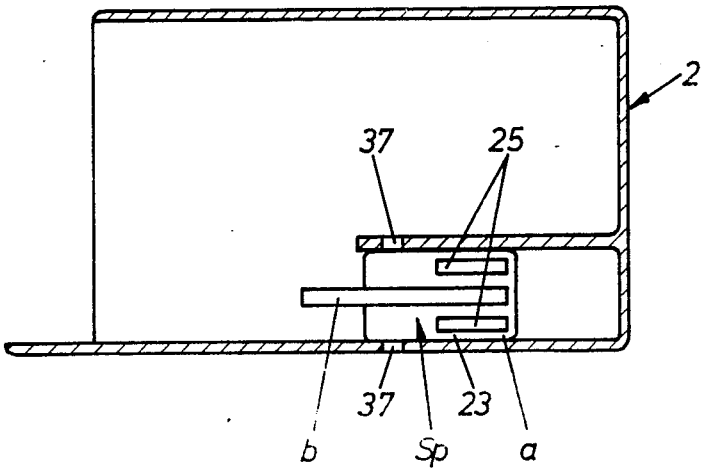
FIG. 24 is a sectional view through the dispenser in the area where the rocker arm pivots.
Figure 27:
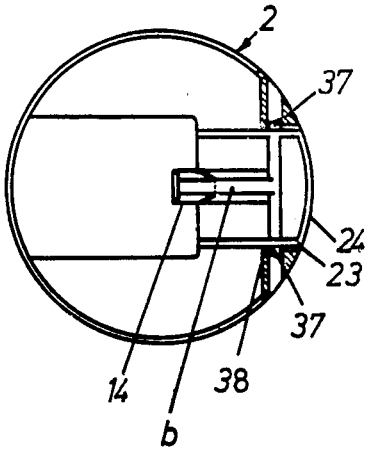
FIG. 27 is a bottom view of the dispenser.

The sixth embodiment also utilizes a horizontally-oriented slide movement. As shown in FIG. 23, the rocker lever 23, spring-loaded towards its home position, protrudes with its arm b into the path of the slide projection 46. This is a strip molded on directly. It protrudes perpendicularly from the flat slide and points into the interior of the housing 2 which also receives the end of the rocker arm b forming the actual detent. The operating face 24 is formed on the outside of the arm a from the free end of which extends a molded-on spring section 25 bearing on the opposite broad side wall of the housing. The irreversible axial snap-on connection explained above is used analogously, but with the difference that no specific bushings 38 need to be molded on since the pins 37 will engage bores in the wall sections.

The seventh embodiment (FIGS. 25–28) also employs horizontal slide movement. The detent Sp is formed by an angular rocker lever 23 mounted in the fulcrum 47 and facing against the direction of movement (to the right) of the slide 4. The arm b of the rocker lever is located in its spring-loaded home position, in locking fashion, with its free end adjacent to the front wall 4' of the slide 4. In its released position, slide 4 enters the open angular space 48 between this arm b and the arm a, forming the operating face 24. The throw range of the rocker lever 23 provides for the spacing from the tablet drop opening 13 formed here by a bottom opening required for releasing the tablet ready for dispensation.

Figure 28:
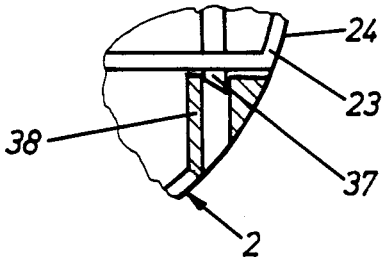
Figure 25:
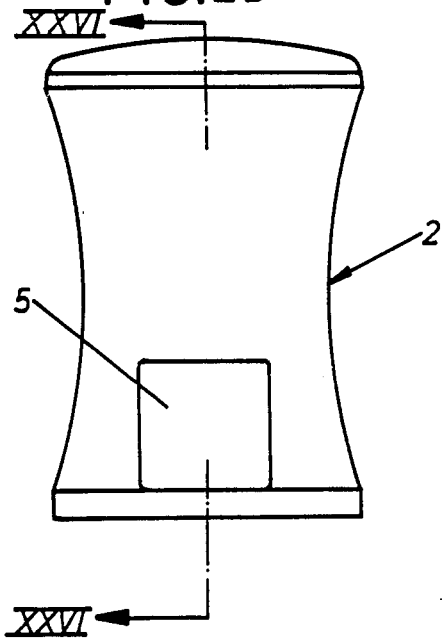
FIG. 25 is the dispenser according to the seventh embodiment, in side elevation, viewed from the side of the operating key.
Figure 26:
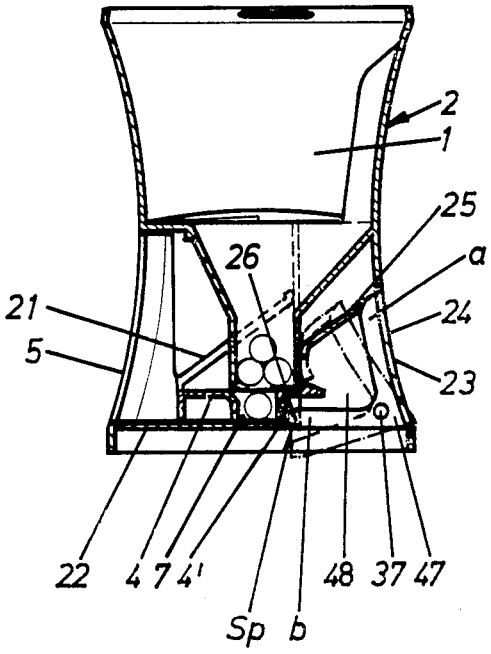
FIG. 26 is a section along line XXVI—XXVI in FIG. 25.

As shown in FIG. 26, the arm a of the rocker lever 23 lies in its spring-loaded home position in the plane of the wall of the housing 2. This housing tapers toward the center and is symmetrical about a vertical axis. The operating key 5 is diametrically opposite from the rocker lever, that is, from its operating face 24 formed by the arm a. The rocker lever 23 is mounted by means of an axial pin snap-on connection. As shown in FIG. 28, the cross-section of the pin terminates in a beveled surface forming a run-on face. This housing 2 again has bushings 38 molded to it.

Having described our invention, we claim:

1. A dispenser for dispensing tablets, said dispenser comprising:
a housing defining a tablet storage compartment and having an outer wall;
a slide movably mounted within said housing;
an operating key disposed adjacent to said housing outer wall, said operating key being movable;
spring means resisting movement of said operating key in one direction;
said slide having a tablet dispensing portion;
said housing having a tablet discharge opening;
said operating key being effective when forced in said one direction to shift said slide to position said tablet dispensing portion in registry with said tablet discharge opening;
means for selectively blocking movement of said slide, said means for blocking comprising a detent mounted upon said housing and spaced from said operating key;
said detent being shiftable from a first position in which it engages and blocks said slide to a second position in which it is disengaged from said slide and permits movement thereof; and
spring means resisting movement of said detent to said second position.

2. The dispenser of claim 1 in which said housing comprises a top, the operating key being disposed at said top and said detent is shiftable in a plane transverse to the plane of slide movement.

3. The dispenser of claim 2 in which said detent comprises a rocker member having a first rocker arm forming an operating face;
a spring section carried by said first rocker arm;
a second rocker arm;
said slide further including a shoulder;
a blocking finger carried by said second rocker arm, said blocking finger being disposed beneath said shoulder when the detent is in said first position.

4. The dispenser of claim 3 in which said housing wall includes a vertical slot and said slide includes a lug extending through said slot, said shoulder being formed on said lug.

5. The dispenser of claim 3 in which said slide includes a lug extending through said tablet discharge opening, said shoulder being formed on said lug, said blocking finger being shiftable away from said tablet discharge opening a distance greater than the diameter of a tablet.

6. The dispenser of claim 3 in which said housing comprises a wall, a sunken recess formed therein, one of said rocker arms being mounted within said recess.

7. The dispenser of claim 3 further comprising a pin mounted on said housing, said rocker member being snap-mounted upon said pin.

8. The dispenser of claim 3 in which the first and second rocker arms are of unequal length with the second rocker arm being longer than the first rocker arm.

9. The dispenser of claim 1 in which said slide carries a depending lug;
and said detent comprises a latch member shiftable transversely of the path of movement of said slide;
said latch member having a recess adapted to receive said lug when said detent is in said second position.

10. The dispenser of claim 1 in which said detent includes a rocker member, said slide includes a lug and said detent comprises a pair of latch members shiftable transversely to the plane of movement of said slide, said latch members being configurated to form a recess for receiving said lug when said dtent is in said second position.

11. The dispenser of claim 10 further comprising a foil hinge interconnected to each of said latch members and to said rocker member.

12. The dispenser of claim 1 in which said detent includes a rocker member, a guide tab carried by said slide, a wall of said housing having a niche therein, said rocker member being disposed to engage said guide tab when said detent is in said first position, said rocker member having two arms disposed at right angles, one of said arms being disposed in said niche when said detent is in said second position.

13. The dispenser of claim 1 in which said detent is slidable, said detent comprising a dividing finger, said dividing finger extending in a direction opposite to the direction of movement of the slide and when said detent is in said first position being disposed for locking engagement with the end wall of said slide, said slide having an opening in its end wall, said finger being in registry with said opening when said detent is in said second position to permit movement of said slide and to separate a tablet positioned for dispensation from the remaining supply of tablets.

14. The dispenser of claim 1 in which said slide comprises a projection disposed within said housing, said detent including a rocker arm, said rocker arm having a first arm and a second arm, when said detent is in said first position said first rocker arm being disposed for engagement with said slide projection.

15. The dispenser of claim 1 in which said detent comprises a rocker member having a first rocker arm and a second rocker arm, said arms extending at an angle relative to one another;
said first arm extending in a direction opposite to the direction of movement of said slide;
means pivotally mounting said rocker member;
said first arm, when said detent is in said first position, having its free end disposed for engagement with said slide;
said detent, when in said second position, being disposed so that said slide can enter the angular space between said first and second arms.

16. The dispenser of claim 1 in which said detent comprises a rocker member having a second arm, said second arm being disposed in the plane of a wall of said housing opposite from said operating key when said detent is in said first position.

17. The dispenser of claim 16 in which said rocker member support pin includes bevelled sections on the end thereof and said rocker member is axially snapped onto said pin.

* * * * *